United States Patent [19]

Margueratt

[11] 4,084,791

[45] Apr. 18, 1978

[54] RESILIENTLY FOUR-WAY TILTABLE VEHICLE JACK BASE

[75] Inventor: Oatway Margueratt, Orillia, Canada

[73] Assignee: Seeburn Metal Products Limited, Beaverton, Canada

[21] Appl. No.: 809,202

[22] Filed: Jun. 23, 1977

[51] Int. Cl.[2] ..... B66F 13/00

[52] U.S. Cl. ..... 254/101; 254/DIG. 1

[58] Field of Search ..... 254/101, DIG. 1

[56] References Cited

U.S. PATENT DOCUMENTS

| | | | |
|---|---|---|---|
| 1,870,087 | 8/1932 | Beckwith | 254/101 |
| 3,881,692 | 5/1975 | Clarke | 254/101 |
| 4,015,825 | 4/1977 | Graafsma et al. | 254/101 |

*Primary Examiner*—Robert C. Watson

[57] ABSTRACT

A resiliently tiltable load supporting base for vehicle jacks is described. The base has a ground engaging base plate having a substantially flat bottom with a convex dome formed at the center thereof. This base has a peripheral stiffening rim with a vertical edge merging into a flared skirt. A load receiving plate with a flat top and downturned peripheral edge is mounted within the base. This load receiving plate has a socket for holding a screw jack post, the bottom wall of the socket having a concave depression pressed into the lower face thereof which rests on the base plate dome. The base plate and load receiving plate are retained together by means of a pin extending through the dome. Hard rubber blocks are mounted between the plates, and are uniformly spaced around the socket to maintain the plates in parallel relationship, while permitting some resilient tilting of a vehicle jack with respect to the base plate.

5 Claims, 3 Drawing Figures

RESILIENTLY FOUR-WAY TILTABLE VEHICLE JACK BASE

BACKGROUND OF THE INVENTION

1. Field of the Invention

This invention relates to a resiliently tiltable load supporting base for vehicle jacks.

2. Description of the Prior Art

The mechanical advantage of the vehicle jacks is usually obtained by screw, lever or hydraulic action. Thus, the screw jack has a threaded screw fitted to a gear wheel which is a part of the base of the jack. This gear wheel engages a pinion gear which is manually turned by means of a handle or crank. The screw jack is widely used as a lightweight vehicle jack. Another form of jack widely used for this purpose is the scissors jack.

The jack is usually mounted on a flat floor or ground engaging base with the post of the jack mounted perpendicularly to this base. One difficulty that has been encountered with the usual jack of the above type is that the support surface is not always level and this may result in jamming of the elevating portion of the jack within the encasing elevator tube.

One prior system for solving the above problem is described in Larson et al, U.S. Pat. No. 1,810,667 which describes a ball and socket joint between base members with fastening bolts and springs positioned at the corners of the base. These springs and bolts permitted a tilting movement about the ball and socket joint.

Another tilting system for vehicle jacks is described in British Pat. No. 817,338, published July 29, 1959. That patent shows the use of rubber blocks as resilient means but the jack is designed for tilting only about one lateral axis.

It is the object of the present invention to provide an improved design of vehicle jack which is resiliently tiltable in at least 4 ways.

SUMMARY OF THE INVENTION

Thus, according to the present invention there is provided a resiliently tiltable load supporting base for vehicle jacks, comprising (a) a rectangular metallic base member having a substantially flat bottom with an upwardly extending convex dome formed at the center thereof, said base member having a peripheral stiffening rim including a vertically upward extending edge merging to an outwardly and downwardly flared skirt;

(b) a metallic load receiving plate having a substantially flat top with downturned peripheral edges positioned for free movement within said base member vertical edge and having a socket extending downwardly in a central region of the top, this socket being adapted to receive a vehicle jack and having a bottom wall with a concave depression pressed upwardly from the bottom face thereof, said concave depression resting on said base member;

(c) a retainer pin member connecting said dome and said concave recess for swinging movement therebetween and (d) elastomeric slab means mounted between said base member and load receiving plate at least beneath the four corners of the flat top portion of the load receiving plate between the socket and the downturned peripheral edges, whereby the load receiving plate is resiliently tiltable with respect to the base member.

The elastomeric slab means is preferably in the form of a hard synthetic or natural rubber block or blocks, e.g. of 60 - 70 durometer hardness. For convience, four such blocks can be used, these being positioned adjacent the four corners of the load receiving plate. Of course, it can also be in the form of a rectangular ring.

The base according to this invention can be adapted for use with any kind of vehicle jack, such as screw jacks, scissors jacks, hydraulic jacks, etc. It is particularly well adapted for use with the usual screw jack having an elevator screw engaging a gear wheel mounted on a vertical axis on the lower end of the jack elevator tube. With this arrangement a bearing support for the gear wheel is mounted in the socket of the load receiving plate.

Constructional forms of the invention will now be described, by way of example only, with reference to the accompanying drawings in which.

Figure 1:
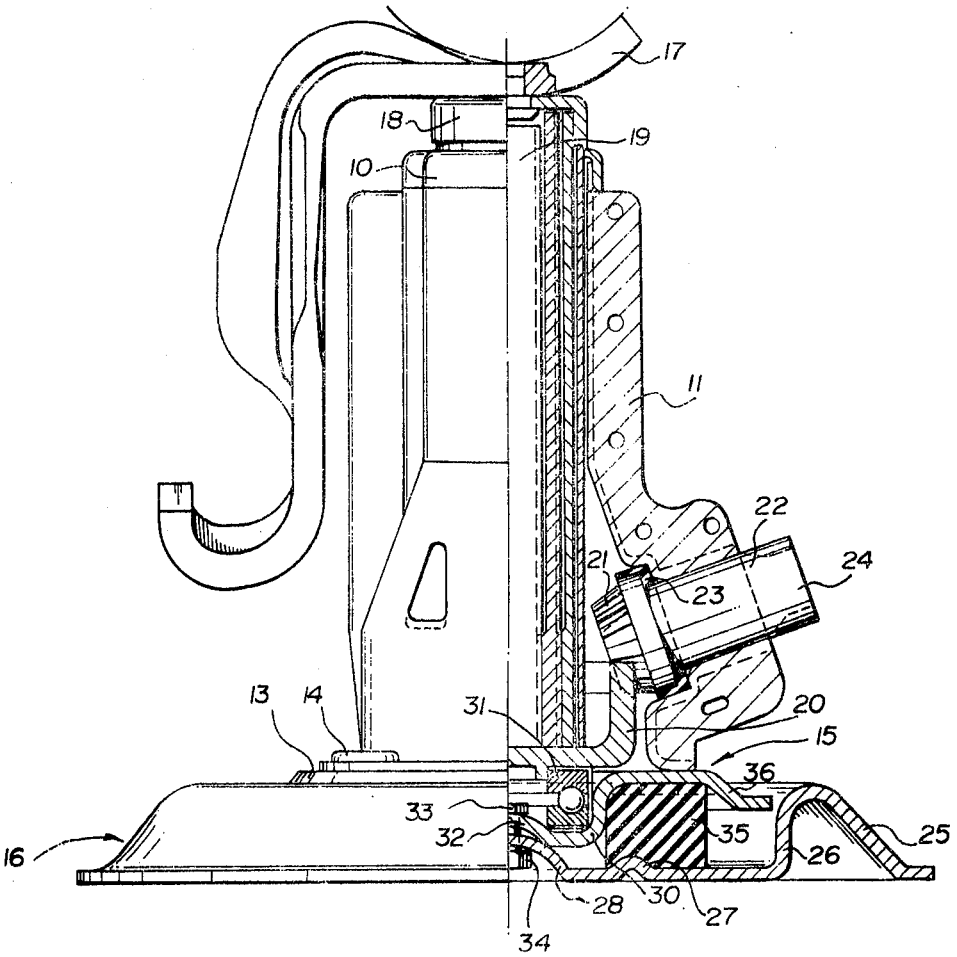
FIG. 1 is a side elevation in partial section showing details of the jack base of the invention.
Figure 2:
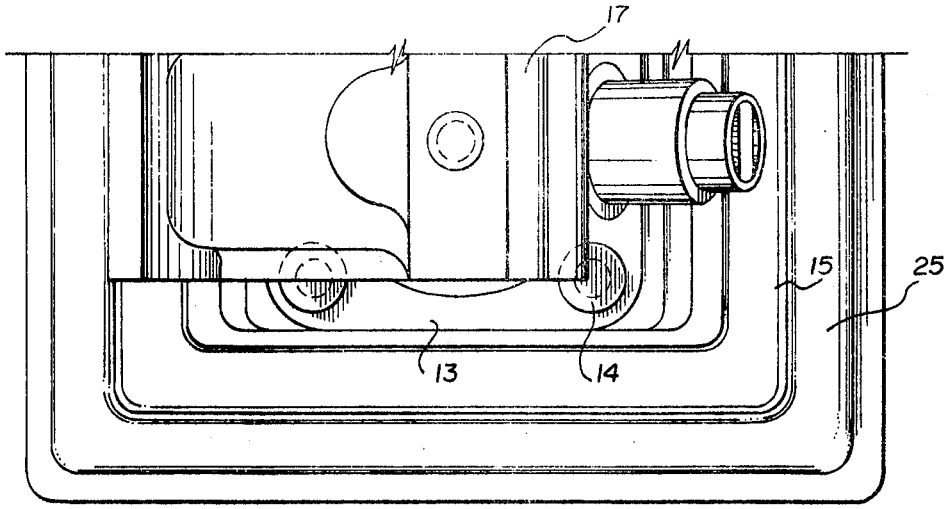
FIG. 2 is a plan view of the jack shown in FIG. 1.

Referring now particularly to FIG. 1, it will be seen that the jack portion has a tubular outer casing or column 10 in the form of two semi-cylindrical halves joined by flanges 11. These flanges 11 can be spot welded or joined in any other means.

Within the column 10 is a telescopic tube 18 which can be typically cold drawn seamless mechanical steel with a cap on which is mounted a load bearing support 17.

The internal mechanism of the jack has not been shown in detail because it is a well known design. Thus, it includes the usual components of a typical screw jack assembly including a threaded elevating shaft 19 rotated by means of gear member 20 supported within a bearing member 31. The gear member 20 is driven by a pinion gear 21. This pinion gear has a cylindrical shank portion 22 with gear teeth 21 at one end and a slot 24 at the other end for receiving a crank handle. The pinion gear is mounted within a friction bearing 23 which can conviently be of material such as that available under the trademark "Derlin".

Looking now at the base of the jack, it will be seen that this includes an outer member 16 and an inner member 15. The outer member 16 has a ground engaging flat bottom portion with upturned peripheral side edges 25. These upturned peripheral side edges include an inner vertical wall 26 defining the perimeter of a rectangular cavity.

The inner tiltable base member 15 has a flat top face portion 37 which peripherally merges into downwardly inclined edge portions 36. It also includes a central downwardly pressed cylindrical socket 30. This socket 30 has in the bottom face thereof a rounded dome portion 32 formed therein which tiltably rests on a rounded dome portion 28 formed in the bottom of outer support base 16. The bottom face of the outer base 16 may also include a stiffening ridge 27.

Figure 3:
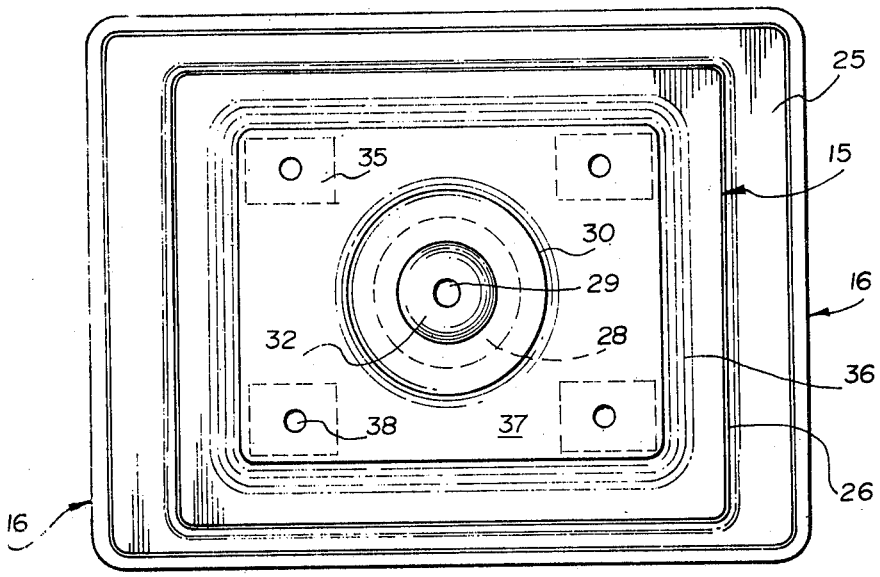
FIG. 3 is a plan view of the base only.

A hole 29 is provided in the center of dome 32 and a corresponding hole is provided in dome 28. A bolt 33 is then passed through these holes and a nut 34 is applied to join together the inner rocking base and the outer support base. Also positioned between the inner and outer bases are rubber blocks 35 and these are positioned at least in the four corners as illustrated in FIG. 3.

Holes 38 are provided in the inner base 15 and the jack portion is rigidly fixed thereto by way of rivets 14 extending through base flange 13 of the jack column and through the inner rocking support base 15. With the jack portion firmly attached in this manner, the device is operational.

The rubber blocks 35 completely fill the vertical space between the support bases 15 and 16 as can be seen from FIG. 1 so that the rubber blocks tend to hold these plates in parallel relationship. However, when the jack is mounted on an irregular floor or uneven ground, the jack column portion can tilt with respect to the base by compressing one or more of the rubber blocks 34. Of course, since these rubber blocks are quite hard, e.g. 60 - 70 durometer hardness, it will be seen that a considerable load is necessary before this tilting occurs. When the load on the jack is released, the resiliency of the rubber blocks causes the bases 15 and 16 to return to their parallel positions as shown in FIG. 1.

I claim:

1. A resiliently tiltable load supporting base for vehicle jacks, comprising:

(a) a rectangular metallic base member having a substantially flat bottom with an upwardly extending convex dome formed at the center thereof, said base member having a peripheral stiffening rim including a vertically upwardly extending peripheral wall merging into an outwardly and downwardly flared skirt;

(b) a rectangular metallic load receiving plate having a substantially flat top with downturned peripheral edges positioned in close proximity to and freely tiltable within said base member vertical peripheral wall and having a socket extending downwardly in a central region of said top, said socket being adapted to receive a vehicle jack and having a bottom wall with a concave depression on the bottom face thereof, said concave depression resting on said base member dome, (c) a retainer pin member connecting said dome and said concave recess for swinging movement therebetween and (d) elastomeric slab means mounted between said base member and load receiving plate at least beneath the four corners of the flat top portion of said load receiving plate between said socket and said downturned peripheral edges, whereby the load receiving plate is resiliently tiltable with respect to the base member.

2. A device according to claim 1 wherein the retainer pin comprises a stud member fixed to said concave depression and having a threaded portion passing through a hole in said base member dome with a nut mounted on said threaded portion beneath said dome.

3. A device according to claim 1 wherein said elastomeric slab means comprises hard synthetic or natural rubber blocks.

4. A device according to claim 3 wherein four elastomeric blocks are positioned beneath the said four corners of the load receiving plate.

5. A device according to claim 1 having a screw jack post mounted in said socket.

* * * * *